US006014124A

United States Patent [19]

Dickinson et al.

[11] Patent Number: 6,014,124

[45] Date of Patent: Jan. 11, 2000

[54] DISPLAY MEANS AND METHODS

[75] Inventors: Alexander George Dickinson, Neptune; Gregory Peter Kochanski, Dunellen; Apollo Wong, Berkely Heights, all of N.J.

[73] Assignee: Lucent Technologies Inc., Murray Hill, N.J.

[21] Appl. No.: 08/729,331

[22] Filed: Oct. 15, 1996

Related U.S. Application Data

[63] Continuation of application No. 08/283,882, Aug. 1, 1994, abandoned.

[51] Int. Cl.[7] ..... G09G 3/36

[52] U.S. Cl. ..... 345/100; 345/212

[58] Field of Search ..... 345/87, 90, 94, 345/99, 100, 211, 212, 213; 359/54, 55, 57, 50

[56] References Cited

U.S. PATENT DOCUMENTS

| | | | |
|---|---|---|---|
| 4,062,626 | 12/1977 | Kawakami et al. | 340/336 |
| 5,093,736 | 3/1992 | Iijima | 359/55 |
| 5,126,727 | 6/1992 | Asars | 340/760 |
| 5,260,606 | 11/1993 | Young | 345/211 |

*Primary Examiner*—Amare Mengistu

[57] ABSTRACT

A passive liquid crystal display is enhanced by selectively applying low frequency signals to the columns of electrodes on the substrates sandwiching a liquid crystal, selectively applying high frequency signals to the rows of the electrodes so the first and second signals activate the liquid crystal at selected ones of said rows and columns, and passive storing the energy in capacitances exhibited by said rows at the high frequency with an inductor. The low frequency is below the crossover frequency of the liquid crystal, and the high frequency above the crossover frequency.

24 Claims, 8 Drawing Sheets

TO M1-MN AND MH1-MHN
LF SOURCE (LF1)
LF1
TO MF1-MF4
HF SOURCE (HF1)
HF1
LH1
LH2
+b
M1
M2
M3
M(N-2)
M(N-1)
MN
IN1
MH1
MH2
MH3
MH1(N-2)
MH1(N-1)
MHN
MF1
MF2
MF3
MF4
TO HF1
LH1
LH2
IH1
L
RL
I
DC1
STANDARD COLUMN DRIVER TO APPLY -C TO SELECTED PIXELS AND +C TO UN-SELECTED PIXELS ON A ROW. (DC1)
BL1
LCD (BL1)
VH1
DR1

DISPLAY MEANS AND METHODS

This is a continuation of application Ser. No. 08/283,882 filed Aug. 1, 1994, now abandoned.

FIELD OF THE INVENTION

This invention relates to liquid crystal displays, and particularly to computers and other devices using passive liquid crystal displays.

BACKGROUND OF THE INVENTION

Liquid-crystal displays suffer from cross-talk between pixels. Whenever a particular pixel is turned on, all the other unselected pixels on the same row and column receive part of the voltage applied to the selected pixel. This causes unselected pixels to partially turn on and results in a low contrast image.

Attempts have been made to overcome these disadvantages by using two frequency addressing. However, two-frequency addressing involves substantial energy consumption at the higher of the two frequencies. This increase in energy use is undesirable in battery operated displays.

SUMMARY OF THE INVENTION

An aspect of the invention involves selectively applying low and high frequency signals to the rows or columns of electrodes on the substrates sandwiching a liquid crystal so the low and high frequency signals activate the liquid crystal at selected ones of said rows and columns, and storing the energy from the capacitances exhibited by the electrodes.

According to another aspect of the invention, the energy required to charge the electrodes is stored an inductor that resonates with the capacitance formed by the rows and columns of electrodes.

According to another aspect of the invention, the low frequency is below 40 kHz and the high frequency 0.5 MHz to 3 MHz.

These and other aspects of the invention are pointed out in the claims. Objects and advantages of the invention will become evident from the following detailed description when read in light of the accompanying drawings.

DETAILED DESCRIPTION OF PREFERRED EMBODIMENTS

Figure 1:
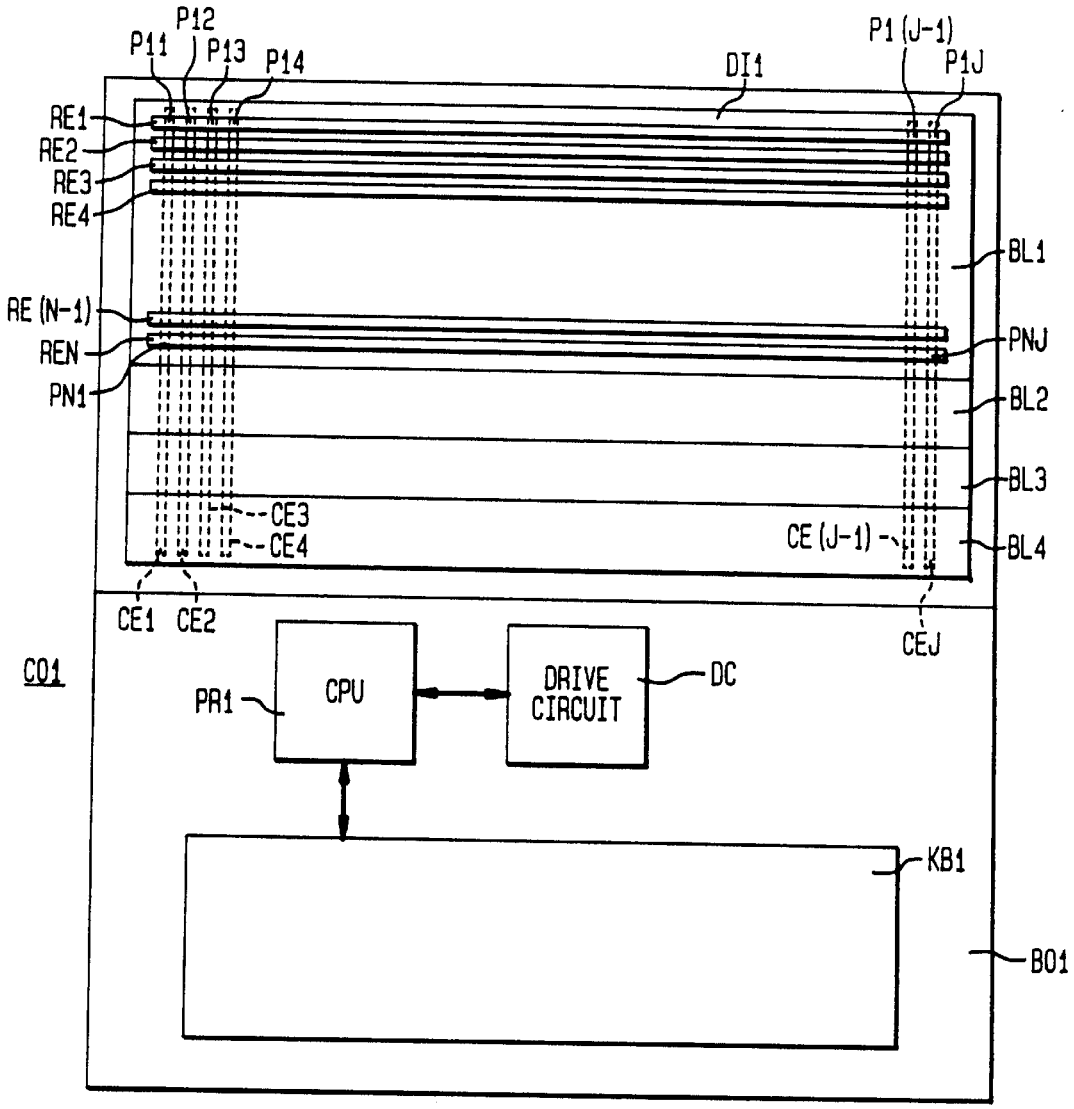
FIG. 1 is a schematic illustration of a computer having a display and embodying features of the invention.

In FIG. 1, a computer CO1 includes a body BO1 with a keyboard KB1 and a processor PR1. A liquid crystal (LCD) display DI1 contains four display blocks BL1, BL2, BL3, and BL4, of which the block BL1 is shown larger than the blocks BL2 to BL4 for convenience in depicting details common to all the blocks. The block BL1 has row electrodes RE1 to REN and shares column electrodes CE1 to CEJ with other blocks BL2 to BL4. The description of the block BL1 pertains equally to the blocks BL2 to BL4. The electrodes RE1 to REN and CE1 to CEJ form rows of pixels P11 to P1J, P21 to P2J . . . , PN1 to PNJ in each of the blocks BL1 to BL4. The electrodes are greatly enlarged in the drawing for convenience. The display DI1 has, for example, a 640×480 pixel resolution with each electrode cross-over representing one pixel. Each block BL1 to BL4 contains 120 row electrodes RE12 REN (N=120) and 640 column electrodes CE1 to CEJ (J=640). This defines 640×120 pixels per block, or a total number of 640×480 pixels in the display DI1.

Figure 2:
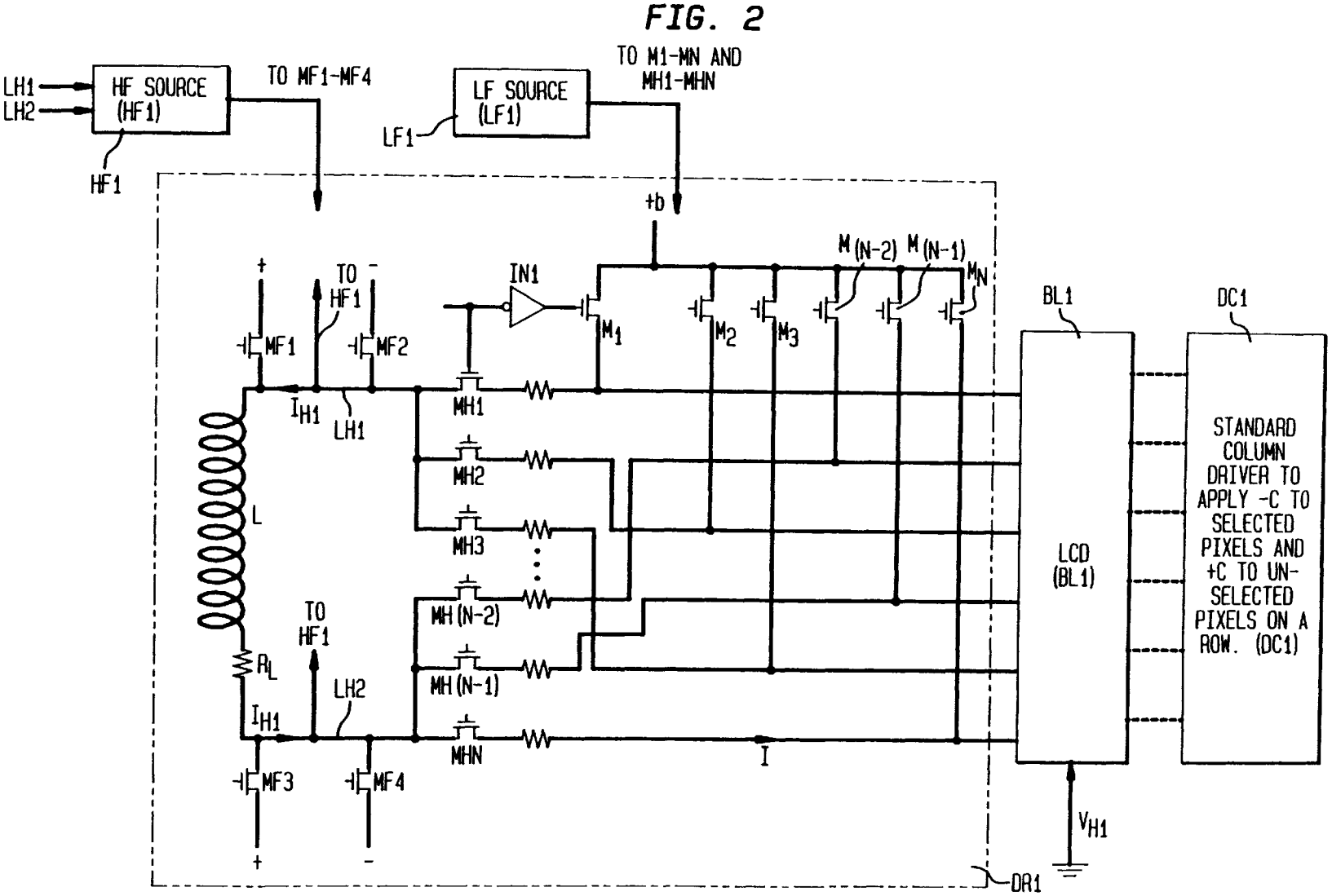
FIGS. 2 and 3 are partially block and partially schematic diagram illustrating details of the device in FIG. 1.
Figure 3:
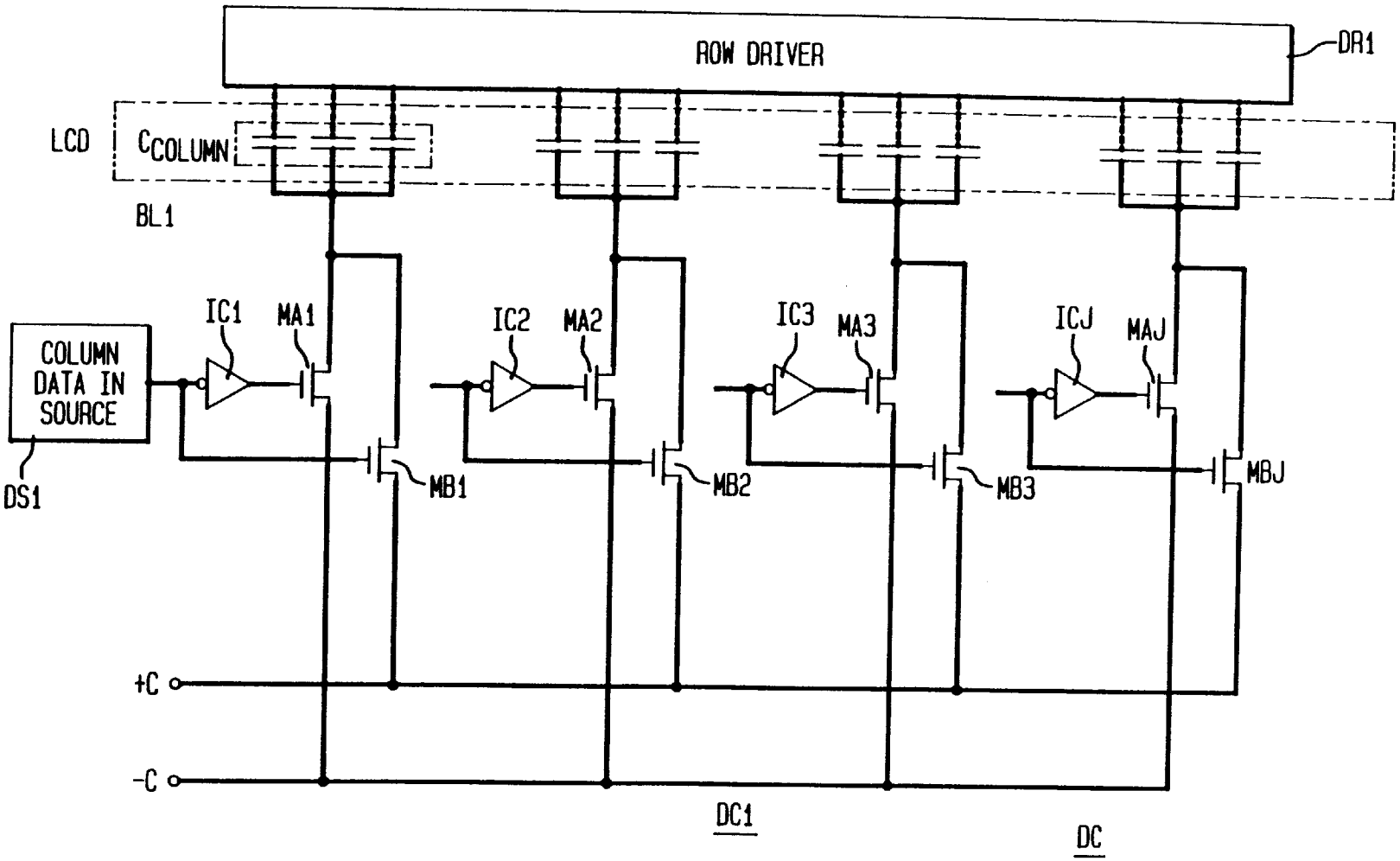

The processor PR1 includes a drive circuit DC details of which appear in FIGS. 2 and 3. As shown in FIGS. 2 and 3 the drive circuit DC contains four row drivers, one for each block BL1 to BL4, and a column driver CD1. FIG. 2 illustrates details of the row driver DR1 for driving the row electrodes RE1 to REN, and FIG. 3 shows details of the column driver DC1, for driving the column electrodes CE1 to CEJ.

In FIG. 2, a source LF1 turns on MOSFETs M1, M2, M3, M4, . . . M(N−1), MN, in complementary synchronism to respective MOSFETs MH1, MH2, MH3, MH4, . . . MH (N−1), MHN. A source b+ energizes the MOSFETs M1 to MN and MH1 to MHN. Suitable inverters, of which an inverter IN1 is shown, provide the complementary synchronism by applying positive input pulses to the MOSFETs M1 to MN while applying negative input pulses to the MOSFETs MH1 to MHN and vice versa. The thus energized and controlled MOSFETs M1 to MN then apply addressing pulses to row electrodes RE1 to REN while disconnecting the row electrodes from an inductor L. The low frequency address input source LF1 operates in the range of, for example, 5 to 40 kHz.

The MOSFET switches herein are shown as if they required a positive gate to source voltage to become highly conductive, for simplicity. According to other embodiments, equivalent circuits are implemented with other electrical devices (such as n-channel depletion mode MOSFETS), and more complex arrangements such as n-type and p-type devices paired to form one switch.

When the MOSFETS MH1 to MHN conduct, they connect the row electrodes RE1 to REN, and their capacitances $C_{row}$, to the inductor L. The latter forms a natural resonant circuit with the total capacitance $C_{TB}$ of the driver DC1. The resonant circuit has a resonant frequency.

$$f_{hi} = \frac{1}{2\pi\sqrt{LC_{TB}}}$$

The value L is chosen so the resonant frequency $f_{hi}$ lies in the range of 0.5 MHz to 3 MHz. Those frequencies are substantially greater, by several times, than a cross-over frequency $f_c$ of the liquid crystal material in the blocks BL1 to BL4 in the display DI1. Molecules in the liquid crystal tend to align parallel to the driving field when driven below $f_c$ and align perpendicular to the field when driven above $f_c$.

Therefore, currents at the high frequency $f_{hi}$ counter the effects of the stray voltage on the unselected pixels. The frequency ranges given are only examples and other ranges are possible.

Application of pulses to the resonant circuit composed of the capacitance $C_{TB}$ and the inductor L initiates ringing at the frequency $f_{hi}$ and maintains the oscillation at that frequency. This results in high frequency currents $I_{HI}$ in lines LH1 and LH2 and in row electrodes RE1 to REN. The high frequency source HF1 maintains the ringing at the frequency $f_{hi}$. It operates a pulser PS1, composed of MOSFETs MF1 to MF4, which applies pulses to start ringing and to maintain ringing of the resonator circuit. Specifically the pulse source HF1 turns on the MOSFETS MF1 and MF4 simultaneously, while holding MOSFETs MF2 and MF3 off, for a brief period during near or at the peak of one half-cycle of the frequency $f_{hi}$, and simultaneously turns on the MOSFETs MF3 and MF2, while holding off MOSFETs MF1 and MF4, for a brief period near or at the peak of the other half cycle.

At the start, when the system is turned on, the resonant circuit composed of the inductor L and the cell capacitances begins ringing at the frequency $f_{hi}$. Then the high frequency source HF1 receives a feedback signal from the oscillating resonant circuit across lines LH1 and LH2 to determine the moments that the MOSFETs MF1 to MF4 are to be turned on and off. This feedback process is a form of automatic frequency control and helps the operation because the capacitance $C_{TB}$ may vary with the number of pixels turned on and off as much as 30%, and to a lesser degree with temperature. Hence, the value of $f_{hi}$ varies. By generating the pulses in synchronism with resonant frequency $f_{hi}$ at or near the peaks of the half cycles of the resonant frequency, the pulse generator changes it frequency or pulse repetition rate and follows the instantaneously varying frequency $f_{hi}$. The maintenance of the pulse resonant frequency in this manner affords a low power system for application of high frequency signals to the row electrodes RE1 to REN. It produces maximum energy storage and return.

MOSFETs MH1, MH2, MH3, MH4, . . . MH(N−1), MHN apply the high frequency signals at lines LH1 and LH2 to the respective row electrodes RE1, RE2, RE3, RE4, . . . RE(N−1), REN during the absence of low frequency addressing pulses at these electrodes. By virtue of their complementary operation, The MOSFETs M1 to MN operate together with the MOSFETs MF1 to MFN to switch either the high frequency signal or the addressing pulses to the row electrodes RE1 to REN. The connections from the MOSFETs MH1 to MHN are such that pairs of alternate rows RE1 to REN receive the high frequency signals in opposite phases. Such opposite phasing reduces radiation. There are M (M=N/2) pairs in each block BL1 to BL4. In the numerical example above M=60.

The electrodes RE1 to REN in each row form capacitances $C_{row}$ with the column electrodes CE1 to CEJ. M pairs of alternate rows RE1 to REN receiving the high frequency signals in opposite phases in the block BL1 are connected together. The capacitances in these pairs of rows resonate with the inductor L between the lines LH1 and LH2 at a frequency $f_{hi}$ higher than the frequency $f_c$ . The inductor L passively stores the energy from the interelectrode capacitances in the block BL1 and transfers the energy back to the capacitances at the high frequency. The driver DR1 and hence the drive circuit DC exhibits a high efficiency because energy in the capacitances formed by the row and column electrodes is swapped to the inductor L rather than being dissipated.

FIG. 3 illustrates the details of the column driver DC1 for driving the column electrodes CE1 to CEJ. Here data passes through inverters IC1 to ICJ to operate MOSFETs MA1 to MAJ, and directly to operate MOSFETs MB1 to MBJ. DC1 is representative of typical device in current use.

Figure 4:
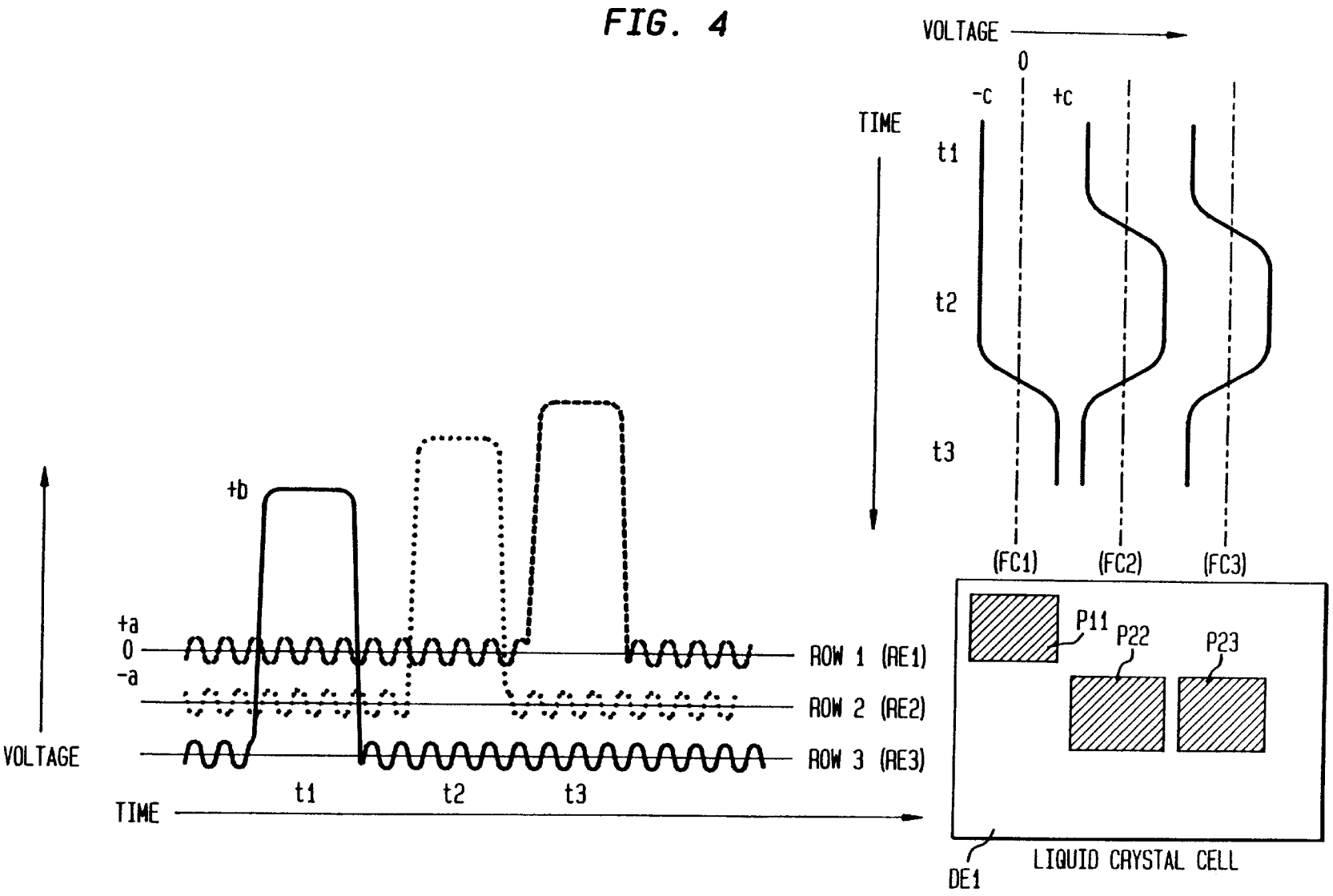
FIG. 4 is a graph illustrating an embodiment of the voltages in the circuit of FIGS. 2 and 3, and the effect on the operation of the device in FIG. 1.

An example of the operation of the drivers DR1 and DC1 in the drive circuit DC appears in FIG. 4. The latter shows a portion of the block BL1 in the display DI1 in FIGS. 1 to 3 and sample voltages applied there at different times. The portion of the block in the display presented is for rows RE1 to RE3 and columns CE1 to CE3 so that the effect on pixels P11 to P33 emerge. The shaded portions represent unactivated pixels. The example here could be for any three adjacent rows and columns. Here, data pulses drive the columns CE1 to CE3. Addressing pulses appear at the row electrodes RE1, RE2, and RE3, with the high frequency signals at the lines LH1 and LH2 occurring between the addressing pulses. The high frequency signals significantly cancel the crosstalk between pixels while the inductor L preserves high frequency energy that has been applied to the interelectrode capacitances and which would otherwise be dissipated in the row driver circuitry DR1, electrode resistances, and the power supply.

In FIGS. 2 to 4, rows are selected one at a time, analogous to a passive addressing scheme. Similarly, the column lines are driven with the image data that corresponds to the appropriate row. The high frequency drive prevents every bit of data from tending to align the liquid crystal between the electrodes and partially activate every pixel. The high frequency drive at the inactive rows reduces the mean alignment strength for a nonselected pixel to some desirably small value. The inductor L reduces dissipation of the energy from the switching of high frequency voltage.

According to another embodiment of the invention, pulses are fed to turn on pixels at the intersections of selected rows and columns, while a uniform high frequency background reduces the effect of the stray voltages to the unselected pixels. The inductor L again reduces energy consumption and as in all the embodiments enhances battery operation.

Figure 5:
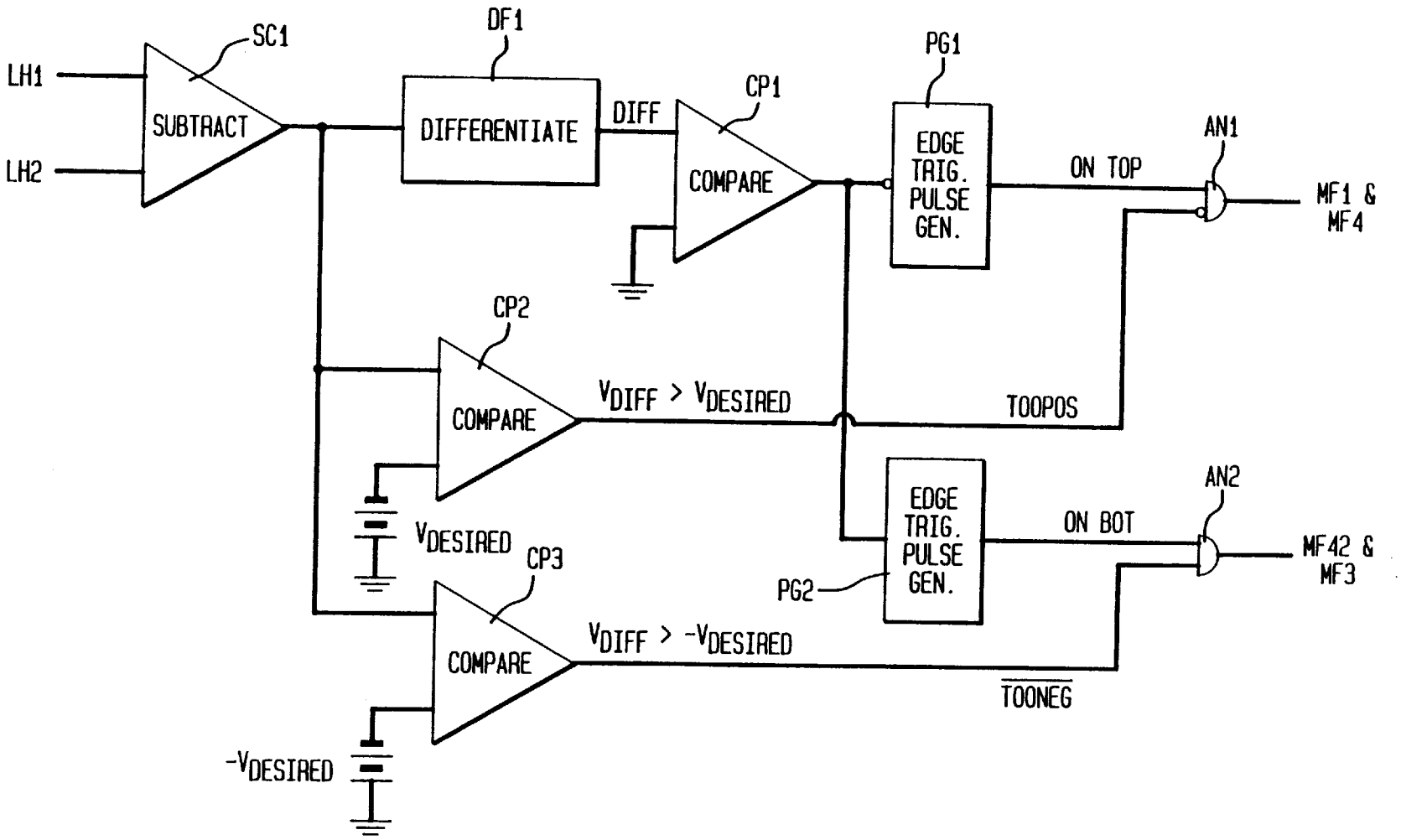
FIG. 5 is a graph illustrating details of a pulse generator in FIGS. 2 and 3.

FIG. 5 illustrates details of an embodiment of the high frequency source HF1 that forms the pulse source for the pulser PS1. The operation appears in FIG. 6. The source HF1 senses when the ringing in the resonator formed by the inductor L and the capacitances of the cells drops below a predetermined value, and pulses the resonant circuit. In FIG. 5, a subtracting circuit SC1 receives the opposing voltages that appear at lines LH1 and LH2. The output of the subtracting circuit appears in FIG. 6.

Figure 6:
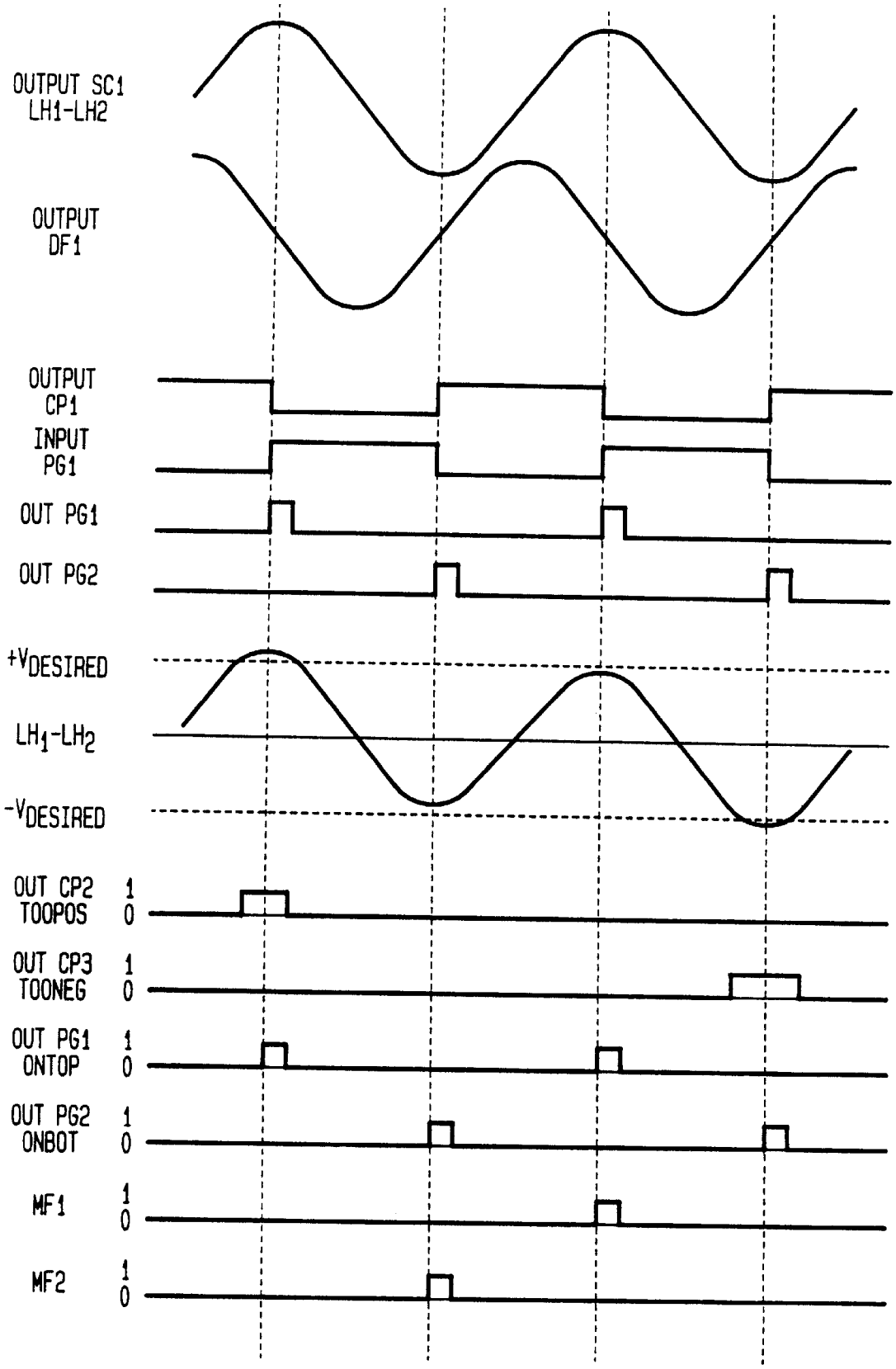
FIG. 6 is a timing diagram showing operation of a pulse generator in FIGS. 2 and 3.

To find the peaks, a differentiator DF1 differentiates the voltage at the output of the circuit SC1. Hence, at the time of the peaks in each of the cycles in the output of the circuit SC1, the voltages at the output of the differentiator DF1 pass through zero as shown in FIG. 6. A comparison circuit CP1 compares the differentiated output of the differentiator DF1 with 0. It produces a logic high or 1 at the peaks of the output of the circuit SC1. The output of comparison circuit CP1 appears in FIG. 6.

An edge trigger pulse generator PG1 with a reversing input produces a single pulse at each transition from 1 to 0, that is only at the positive peaks. (See FIG. 6.) These pulses appear at an input of an AND gate AN1. When enabled, the AND gate AN1 applies the triggers to the MOSFETs MF1 and MF4. When enabled, this would pulse the resonant circuit at the positive peaks. Another edge trigger pulse generator PG2 produces a single pulse at each transition from 0 to 1, that is only at the negative peaks. These pulses appear at an input of an AND gate AN2. (See FIG. 6.) When enabled, the AND gate AN2 applies the triggers to the MOSFETs MF2 and MF3. When enabled, this would pulse the resonant circuit at the negative peaks.

The source HF1 enables the gates AN1 and AN2 only when the positive peaks fall below a desired positive value and the negative peaks are more positive than a desired negative value. For this purpose, a comparison circuit CP2 compares the difference voltage from the circuit SC1 to a desired positive voltage $V_{desired}$. As shown in FIG. 6 at the Out CP2, this produces a logic 1 at the output of comparison circuit CP2 when the input voltage exceeds the desired positive voltage. This indicates that the difference voltage $LH_1-LH_2$ is too high to require enhancement. Thus, the too positive indicator appears at an inverted input of an AND gate AN1 and disables it. A voltage less than the desired voltage produces a logic 0 and enables the AND gate AN1. At the next trigger pulse from the generator PG1, the AND gate AN1 pulses the MOSFETs MF1 and MF4 and triggers the resonant circuit.

A comparison circuit CP3 compares the difference voltage from the circuit SC1 to a desired positive voltage $V_{desired}$. As shown at line Out CP3 in FIG. 6, it produces a logic 0 at the output of comparison circuit CP3 when the input voltage is more negative than the desired negative voltage. This indicates that the difference voltage $LH_1-LH_2$ is too negative and requires pulsing. Thus, the too negative inducator appears at an input of an AND gate AN2 and disables it. A voltage more than the desired negative voltage produces a logic 1 and enables the AND gate AN1. At the next trigger pulse from the generator PG2 at the next negative peak, the AND gate AN2 pulses the MOSFETs MF2 and MF3 and feeds the resonant circuit.

The pulses at the MOSFETs MF1 and MF4 appear across the lines LH1 and LH2 when positive peaks fail to reach the desired positive values, and the pulses at the MOSFETs MF2 and MF3 AN2 appear across the lines LH1 and LH2 in the opposite directions during the negative peaks. As the natural frequency varies, the timing of the peaks changes. This changes the timing of the pulses to conform them to the changing natural frequency. An automatic frequency control results.

According to another embodiment of the invention, frequency control is realized by replacing the differentiator with a R–C network that produced slightly more than 90° phase lead at the operating frequency. Generators PG1 and PG2 are then triggered slightly before the peak at each cycle, and their pulses adjusted to end slightly beyond the peak of each cycle.

According to yet another embodiment, the width of pulses from generators PG1 and PG2 are adjusted in a continuous fashion, depending on the difference LH1–LH2. Such a structure results in a constant high frequency voltage, and thus a uniform image on the display. A circuit samples and rectifies the voltages LH1 and LH2 at the peaks of their waveform, and standard control system techniques determine the length of the pulses from generators PG1 and PG2. One normally skilled in the art can produce many equivalent implementations, including digital (microprocessor based) or "fuzzy logic" versions of HF1 that would follow the frequency of the resonance, while maintaining its amplitude constant.

This invention allows for the operation of dual-frequency driving for displays with a large number of rows with acceptable power consumption.

Figure 8:
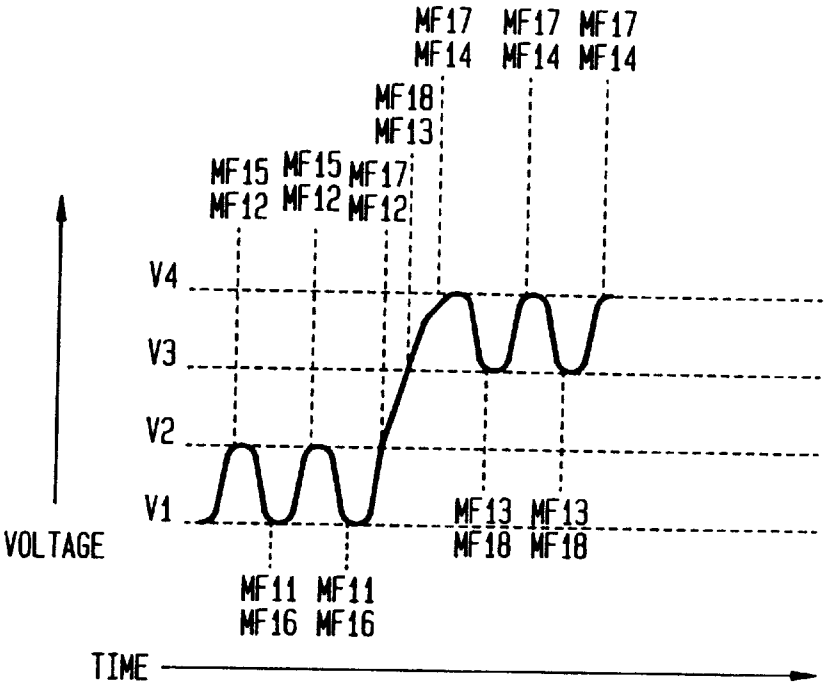
FIG. 8 is a sample of driving waveforms arising from use of the generator of FIG. 7 in the circuit of FIG. 2.
Figure 7:
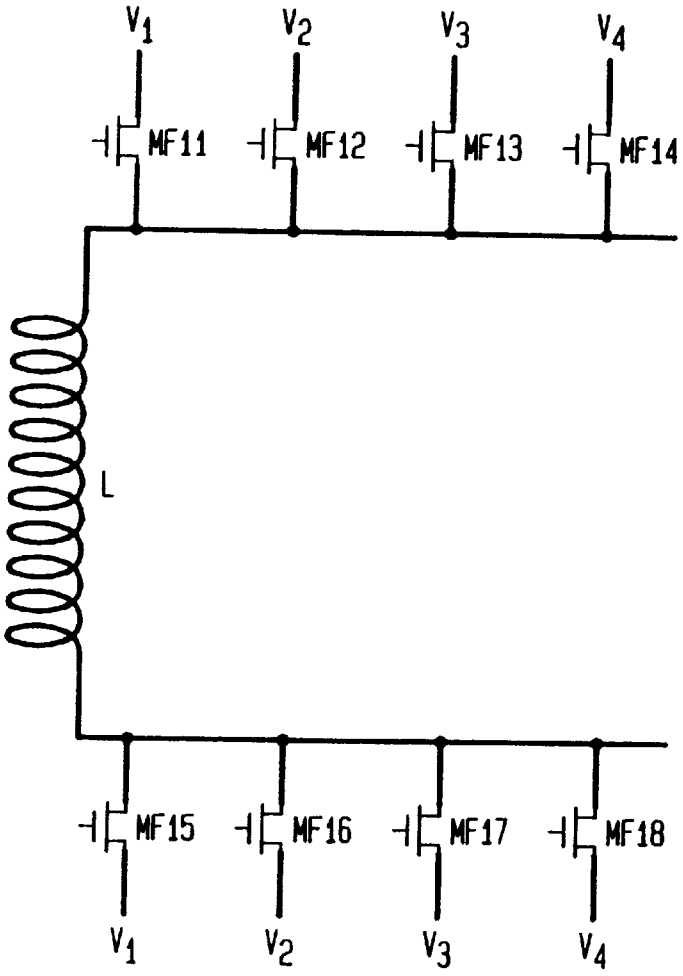
FIG. 7 is a schematic diagram illustrating high frequency generator for the circuit in FIG. 2.

According to an embodiment of the invention 480 row electrodes RE1 to REN are driven on both ends with the energy saving circuit shown in FIGS. 2 and 3. In addition, the power dissipation can be lowered by allowing the high frequency drive to take on more than two values. FIG. 7 shows a circuit to produce a 4-level drive. Here, voltages $V_1$ to $V_4$ create four levels. High frequency control voltages at MOSFET; MF11 to MF18 produce the waveforms shown in FIG. 8 in most instances.

In most instances, the capacitance is dominated by the LCD in each block of the display DI1 itself. In one example a row has a capacitance of 360 pf. The inductor L provides efficient energy storage so the same current flows everywhere in the loop from the capacitance of the LCD in each block of the display DI1, through the inductor and back to the block of the display DI1. Losses arise from the dissipation in the internal resistance $R_{sw}$ of each MOSFET MH1 to MHN in series with the pulser PS1 the internal resistance $R_r$ of the block in the display DI1, and the internal resistance $R_L$ of the inductor L. Losses in the MOSFETS M1 to MN of FIG. 2 are low enough to be neglected, as they operate only once per frame, when the +b voltage is applied to the row. MOSFETS $M_{11}-M_{14}$ operate every cycle of $f_{hi}$, but they are used only to supply the small amount of power that is dissipated in the other components. Losses in these devices are small compared to the total dissipation. Only four such transistors serve for a chip that drives hundreds of lines. Thus much circuitry can be devoted to running these transistors in as efficient a manner as possible.

The invention thereby furnishes energy recovery circuitry that drive the electrodes through LC oscillators. A substantial saving in energy is thus realized.

With resistance $R_{sw}$, and the resistance of the LCD row ($R_{row}=\rho_{ITO\square}l_rN/L_c$), the ITO resistance per square $\rho_{ITO\square}=2\Omega/\square$ (approximately 0.5 $\mu$m thick), and get $R_{row}=1300\Omega$.

The inductor has resistance $R_L$, which derives from its inductance and size. With a sample capacitance $C_{row}$ of 360 pf, the inductance required to resonate with the capacitance of the block BL1 in the LCD display DI1 is $$L = \frac{1}{2\pi^2 f_{hi}^2 M C_{row}}, \tag{6}$$

where the two LCD rows are electrically in series for the resonant circuit. With M=60, i.e. the number of pairs of electrodes in the block, the inductance is $4.7\times10^{-6}$ H, a plausibly small value to package with a drive.

According to an embodiment of the invention, the inductor L1 is a toroid inductor.

It has been calculated that embodiments of the invention can reduce the drive power substantially, by a factor of 5 and even 10 over earlier implementations of two-frequency addressing, bringing the driver power down below a watt.

The invention furnishes its results by making use of the frequency response of liquid crystals. Liquid crystals are useful for displays because their structure can be affected by modest electric fields. The "handle" that allows the field to rotate the molecules is the anisotropic dielectric constant of the molecules. The anisotropy results from the geometry of the molecules and their intrinsic dipole moment.

End-to-end reversals of the molecules are frequent, typically on a nanosecond to microsecond time scale, although rate on the picosecond time scale of molecular vibrations. At low frequencies, an applied electric field changes the relative population of molecules pointing parallel to and antiparallel to the applied field. The molecules tend to orient in a manner to cancel the applied field, resulting in a large dielectric constant. At frequencies high compared to a typical reversal rate, the molecules cannot reorient in one cycle of the electric field, and the dielectric constant is (typically) lowered. Other, weaker, dielectric relaxations can also be seen in many liquid crystals, resulting from reorientation of subunits of the molecules.

The dielectric anisotropy ($\delta\epsilon$), which is defined as the difference of dielectric constants along the directions parallel and perpendicular to the long axis of the liquid crystal molecule, changes sign when the driving frequency goes above a cross-over frequency $f_c$, which is typically close to the molecular reversal rate. The molecules will tend to align parallel to the driving field when driven below $f_c$ and align perpendicular to the field when driven above $f_c$. Therefore, the effects of the stray voltage on the unselected pixels can be countered by the application of a high frequency driving voltage.

While $f_c$ varies with design of the liquid-crystal mixture, according to the invention, the high-frequency drive components must be at several times $f_c$.

The cross-over frequency $f_c$ has a very strong temperature dependence. The value $f_c$ can vary from several kilohertz to a hundred kilohertz as the temperature changes from 0° C. to 40° C. Typically, a drive frequency around 50 KHz to 100 KHz was used in the past. This was a problem because energy is dissipated in the process of charging and discharging the capacitance across the liquid crystal, and this power is proportional to the driving frequency. Thus, in the past implementations of the two-frequency driving scheme, there has always been a trade off between workable temperature range and power dissipation. For a 1000 $cm^2$ panel with typical capacitance of 300 pf/row driven at 1 MHz with 10V p—p, the energy lost charging the capacitance can be as high as 3.3 W, rendering the traditional two-frequency driving scheme unsuitable for battery powered applications. The invention reduces the energy loss by storing the energy from the interelectrode capacitances in the inductor.

The invention adds a high frequency drive to the inactive rows, so that the mean alignment strength for a nonselected pixel is reduced to some desirably small value. It avoids the losses arising from the high frequency operation with the inductor.

In the embodiments shown, the number of different voltage levels that the driver circuits produce is minimized. This is a "brute force" approach, with the simplest circuit, but involve higher power consumption. Other embodiments of the invention utilize more complex driver schemes, analogous to typical optimized amplitude single-frequency passive LCD drives.

In the embodiments shown, the inactive rows are driven between ±a at high frequency, and the active row is set to b. Columns are set to c (nonselected), or −c (selected).

A further embodiment of the invention involves providing means to intentionally change the $(LC)^{-1/2}$ time constant. To do this, additional conductors or capacitors are switched in parallel or series with L, as means of adjusting $f_{hi}$. For example, at low temperatures, when $f_o$ is reduced, $f_{hi}$ is lowered to further reduce the overall power dissipation. This is accomplished by switching a capacitor across L, or adding an inductor in series with L, by means of MOSFET switches. According to another embodiment, the inductor L is a tapped inductor with MOSFET switches selecting the optimal tap. Such techniques control $f_{hi}$, as the image (and thus the pixel capacitances) changed.

The dual-frequency driving arranged has increased the contrast at the expense of increasing power consumption. This is potentially very important for displays on supertwist nematic (STN) liquid crystals. The ideal STN for this scheme will not be as nearly bistable as in a normal display. The display would then be less sensitive to variations in the cell gap than a normal STN display, and might even be capable of good grey scales. The restoring torque exerted by the high frequency drive in the embodiments would also solve the slow speed problem of conventional STN displays. Owing to the energy saving of the invention, the high frequency driving voltage can operate in megahertz range. This may very well be high enough for most of the common STN's.

Figure 9:
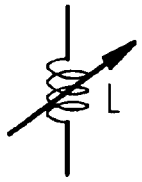
FIG. 9 illustrates the inductor of FIG. 2 wherein the inductance is adjustable.

FIG. 9 illustrates the inductor of FIG. 2 wherein the inductance is adjustable.

Figure 10:
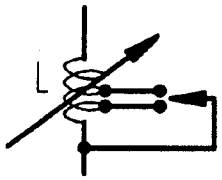
FIG. 10 illustrates the inductor of FIG. 2 wherein the inductance is adjustable by taps.

FIG. 10 illustrates the inductor of FIG. 2 wherein the inductance is adjustable by taps.

Figure 11:
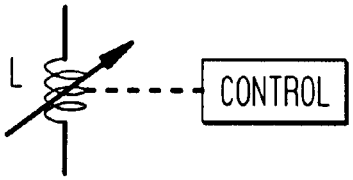
FIG. 11 illustrates the inductor of FIG. 2 wherein control means vary the inductance of the inductor.

FIG. 11 illustrates the inductor of FIG. 2 wherein control means vary the inductance of the inductor.

Sources other than the type shown in FIG. 5, for triggering and maintaining ringing at the natural frequency of a resonant circuit may be used. The particular source shown, and its operation, are only examples.

While embodiments of the invention have been described in detail, it will be evident to those skilled in the art that the invention may be embodied otherwise without departing from its spirit and scope.

What is claimed is:

1. A display method, comprising:

selectively applying operating signals in a first frequency range to rows and columns of electrodes arranged in rows and columns on substrates sandwiching a liquid crystal, said rows exhibiting capacitances that vary;

selectively applying supplementary signals at frequencies in a second frequency range higher than the first frequency range to the rows of said electrodes during the absence of said operating signals at said rows;

said step of applying supplementary signals includes forming resonant conditions with the varying capacitances of said rows and storing energy from capacitances exhibited by a plurality of said rows at the frequencies in the second frequency range; and maintaining the supplementary signals and the resonant conditions with the capacitances over a plurality of cycles of the frequencies in the second frequency range.

2. A method as in claim 1, wherein the step of storing the energy is performed by an inductor which operates at a resonant frequency with the capacitances of the rows.

3. A method as in claim 2, wherein the liquid crystal has a crossover frequency and the first frequency range is below the crossover frequency of the liquid crystal.

4. A method as in claim 3, wherein the second frequency range is above the crossover frequency of the liquid crystal.

5. A method as in claim 2, wherein said frequencies in the second frequency range are produced by forming a ringing signal with said inductor and a row.

6. A method as in claim 1, wherein the step of storing the energy is performed by an inductor which operates at a resonant frequency with the capacitances of a plurality of said rows, and said maintaining of the resonant conditions occurs throughout the absence of the operating signals at said rows.

7. A method as in claim 6, wherein the liquid crystal has a crossover frequency and the second frequency range is above the crossover frequency of the liquid crystal.

8. A method as in claim 6, wherein said frequencies in the second frequency range are produced by forming a ringing signal with said inductor and said rows.

9. A method as in claim 1, wherein the liquid crystal has a crossover frequency and the first frequency range is below the crossover frequency of the liquid crystal.

10. A method as in claim 9, wherein the second frequency range is above the crossover frequency of the liquid crystal.

11. A method as in claim 9, wherein the liquid crystal has a crossover frequency and the second frequency range is above the crossover frequency of the liquid crystal.

12. A method as in claim 1, wherein the liquid crystal has a crossover frequency and the second frequency range is above the crossover frequency of the liquid crystal.

13. A display apparatus, comprising:

a liquid crystal sandwich having a plurality of rows and columns of electrodes, said rows exhibiting capacitances;

a pair of sources of pixel selecting signals in a first frequency range coupled to said rows and columns;

a supplemental source of supplementary signals in a frequency range higher than said first frequency range and coupled to said rows; and said supplemental source including an energy storage device coupled to the capacitances exhibited by said rows in energy exchange relationship with the capacitances at the higher frequency range and forming resonant conditions with the capacitances exhibited by said rows, and means for maintaining application of the supplementary signals at the resonant conditions for a plurality of cycles of the higher frequency range.

14. An apparatus as in claim 13, wherein said energy storage device includes an inductor.

15. An apparatus as in claim 14, wherein liquid crystal has a crossover-frequency and the first frequency range at the pair of sources is below the crossover frequency of the liquid crystal.

16. An apparatus as in claim 15, wherein the frequency range of said supplementary signals is above the crossover frequency of the liquid crystal.

17. An apparatus as in claim 14, wherein the liquid crystal has a crossover frequency and the frequency range of said supplementary signals is above the crossover frequency of the liquid crystal.

18. An apparatus as in claim 13, wherein said energy storage device includes an inductor in energy exchange relationship with a plurality of said rows, and said means for maintaining maintains the resonant conditions throughout the absence of the operating signals at said rows.

19. An apparatus as in claim 13, wherein liquid crystal has a crossover-frequency and the first frequency range at the pair of sources is below the crossover frequency of the liquid crystal.

20. An apparatus as in claim 19, wherein the frequency range of said supplementary signals is above the crossover frequency of the liquid crystal.

21. An apparatus as in claim 19, wherein supplemental source a ringing generator including said energy storage device and a pulsing generator.

22. An apparatus as in claim 13, wherein the liquid crystal has a crossover frequency and the frequency range of said supplementary signals is above the crossover frequency of the liquid crystal.

23. An apparatus as in claim 13, wherein said supplemental source is a ringing generator including said energy storage device and a pulsing generator.

24. An apparatus as in claim 13 wherein said liquid crystal sandwich is a supertwist nematic liquid crystal.

* * * * *